US006213758B1

(12) United States Patent
Tesar et al.

(10) Patent No.: US 6,213,758 B1
(45) Date of Patent: Apr. 10, 2001

(54) BURNER AIR/FUEL RATIO REGULATION METHOD AND APPARATUS

(75) Inventors: Michael G. Tesar; Michael P. Bria, both of Green Bay, WI (US)

(73) Assignee: Megtec Systems, Inc., Depere, WI (US)

( * ) Notice: Subject to any disclaimer, the term of this patent is extended or adjusted under 35 U.S.C. 154(b) by 0 days.

(21) Appl. No.: 09/436,011

(22) Filed: Nov. 9, 1999

(51) Int. Cl.[7] ..... F23N 15/00
(52) U.S. Cl. ..... 431/12; 431/19; 431/89
(58) Field of Search ..... 431/12, 19, 89, 431/90; 239/61; 266/89; 236/14; 137/606

(56) References Cited

U.S. PATENT DOCUMENTS

| | | | | |
|---|---|---|---|---|
| 1,174,003 | * | 2/1916 | Gibson | 236/14 |
| 1,620,240 | * | 3/1927 | Smoot | 431/19 |
| 1,736,752 | * | 11/1929 | Smith | 236/14 |
| 1,736,753 | * | 11/1929 | Smith | 236/14 |
| 2,197,171 | * | 4/1940 | Annin | 236/14 |
| 2,220,837 | * | 11/1940 | Donaldson, Jr. | 236/14 |
| 2,777,289 | | 1/1957 | Boucher et al. | 60/39.28 |
| 2,963,082 | | 12/1960 | Binford et al. | 158/36 |
| 3,070,149 | | 12/1962 | Irwin | 158/1 |
| 3,164,201 | | 1/1965 | Irwin | 158/28 |
| 3,269,448 | | 8/1966 | Martin | 158/28 |
| 3,373,007 | | 3/1968 | Ticknor | 65/161 |
| 3,602,487 | | 8/1971 | Johnson | 263/19 A |
| 3,694,137 | | 9/1972 | Fichter et al. | 431/283 |
| 3,792,330 | * | 2/1974 | Ottoson | 318/269 |
| 3,815,002 | * | 6/1974 | Clemente et al. | 318/380 |
| 3,916,276 | * | 10/1975 | Ottoson | 318/269 |
| 3,968,489 | | 7/1976 | Richards et al. | 340/417 |
| 4,033,505 | | 7/1977 | Lutes et al. | 236/15 BD |
| 4,067,684 | | 1/1978 | McInerney | 431/90 |
| 4,097,218 | | 6/1978 | Womack | 431/76 |
| 4,252,300 | | 2/1981 | Herder | 266/144 |
| 4,260,363 | | 4/1981 | Cratin, Jr. | 431/76 |
| 4,262,843 | | 4/1981 | Omori et al. | 236/15 C |
| 4,264,297 | | 4/1981 | Van Berkum | 431/76 |
| 4,330,261 | | 5/1982 | Sun | 431/14 |
| 4,334,855 | | 6/1982 | Nelson | 431/20 |
| 4,362,499 | | 12/1982 | Nethery | 431/12 |
| 4,373,897 | | 2/1983 | Torborg | 431/20 |
| 4,375,950 | | 3/1983 | Durley, III | 431/12 |
| 4,406,611 | | 9/1983 | Michel | 431/12 |

(List continued on next page.)

FOREIGN PATENT DOCUMENTS

| | | |
|---|---|---|
| 0 050 840 | 5/1982 | (EP) . |
| 0 088 717 | 9/1993 | (EP) . |
| 54-129531 | 8/1979 | (JP) . |
| 8480894 | 7/1981 | (RU) . |
| 909448 | 2/1982 | (RU) . |

OTHER PUBLICATIONS

Article dated Jan. 23, 1998 from Maxon Corporation; "SmartFire Intelligent Combustion Control System".

Bulletin 7000; Maxon Corporation; "Flow Control Valves".

*Primary Examiner*—Ira S. Lazarus
*Assistant Examiner*—David Lee
(74) *Attorney, Agent, or Firm*—Mitchell D. Bittman; Kevin S. Lemack

(57) ABSTRACT

Control system and method for regulating the air/fuel mix of a burner for a web dryer or a regenerative or recuperative oxidizer, for example. Differential air pressure is monitored between the air chamber of the burner and the enclosure into which the burner fires (such as a flotation dryer or the combustion chamber of a regenerative thermal oxidizer). Fuel flow is monitored by a differential pressure measurement between the fuel chamber of the burner and the enclosure into which the burner fires. These measurements are compared to predetermined values, and the fuel flow and/or air flow to the burner is regulated accordingly.

8 Claims, 8 Drawing Sheets

Preferred System Schematic

U.S. PATENT DOCUMENTS

| | | | | |
|---|---|---|---|---|
| 4,411,385 | | 10/1983 | Lamkewitz | 237/2 A |
| 4,421,473 | | 12/1983 | Londerville | 431/76 |
| 4,436,506 | | 3/1984 | Berkhof | 431/76 |
| 4,498,863 | | 2/1985 | Hanson et al. | 431/89 |
| 4,585,161 | | 4/1986 | Kusama et al. | 236/15 BD |
| 4,645,450 | * | 2/1987 | West | 431/12 |
| 4,688,547 | | 8/1987 | Ballard et al. | 126/116 A |
| 4,887,958 | | 12/1989 | Hagar | 431/12 |
| 4,927,351 | | 5/1990 | Hagar et al. | 431/12 |
| 4,978,291 | | 12/1990 | Nakai | 431/12 |
| 5,207,008 | | 5/1993 | Wimberger et al. | 34/23 |
| 5,222,887 | | 6/1993 | Zabielski, Sr. | 431/12 |
| 5,634,786 | | 6/1997 | Tillander | 431/90 |
| 5,997,280 | * | 12/1999 | Welz Jr. et al. | 431/90 |

* cited by examiner

BURNER AIR/FUEL RATIO REGULATION METHOD AND APPARATUS

FIELD OF THE INVENTION

The present invention relates to burners, and more particularly to a method and apparatus for regulating the ratio of air to fuel in the burner to optimize the burner performance.

BACKGROUND OF THE INVENTION

In drying a moving web of material, such as paper, film or other sheet material, it is often desirable that the web be contactlessly supported during the drying operation, in order to avoid damage to the web itself or to any ink or coating on the web surface. A conventional arrangement for contactlessly supporting and drying a moving web includes upper and lower sets of air bars extending along a substantially horizontal stretch of the web. Heated air issuing from the air bars floatingly supports the web and expedites web drying. The air bar array is typically inside a dryer housing which can be maintained at a slightly sub-atmospheric pressure by an exhaust blower that draws off the volatiles emanating from the web as a result of the drying of the ink thereon, for example.

One example of such a dryer can be found in U.S. Pat. No. 5,207,008, the disclosure of which is hereby incorporated by reference. That patent discloses an air flotation dryer with a built-in afterburner, in which a plurality of air bars are positioned above and below the traveling web for the contactless drying of the coating on the web. In particular, the air bars are in air-receiving communication with an elaborate header system, and blow air heated by the burner towards the web so as to support and dry the web as it travels through the dryer enclosure.

Regenerative thermal apparatus is generally used to incinerate contaminated process gas. To that end, a gas such as contaminated air is first passed through a hot heat-exchange bed and into a communicating high temperature oxidation (combustion) chamber, and then through a relatively cool second heat exchange bed. The apparatus includes a number of internally insulated, heat recovery columns containing heat exchange media, the columns being in communication with an internally insulated combustion chamber. Process gas is fed into the oxidizer through an inlet manifold containing a number of hydraulically or pneumatically operated flow control valves (such as poppet valves). The process gas is then directed into the heat exchange media which contains "stored" heat from the previous recovery cycle. As a result, the process gas is heated to near oxidation temperatures by the media. Oxidation is completed as the flow passes through the combustion chamber, where one or more burners are located (preferably only to provide heat for the initial start-up of the operation in order to bring the combustion chamber temperature to the appropriate predetermined operating temperature). The process gas is maintained at the operating temperature for an amount of time sufficient for completing destruction of the volatile components in the process gas. Heat released during the oxidation process acts as a fuel to reduce the required burner output. From the combustion chamber, the process gas flows through another column containing heat exchange media, thereby cooling the process gas and storing heat therefrom in the media for use in a subsequent inlet cycle when the flow control valves reverse. The resulting clean process gas is directed via an outlet valve through an outlet manifold and released to atmosphere, generally at a slightly higher temperature than inlet, or is recirculated back to the oxidizer inlet.

According to conventional combustion science, each type of burner flame (e.g., premix flame, diffusion flame, swirl flame, etc.) burns with a different optimal burner pressure ratio of fuel to combustion air, by which optimal stoichiometric low emission concentrations in the burner flue gas appear. It is therefore important to control or maintain the desired optimal burner fuel/air pressure ratios of the burner. Failure to closely regulate the burner air/fuel ratio over the range of burner output can lead to poor flame quality and stability (flameout, yellow flames, etc.) or excessive pollution (high $NO_x$, CO).

To that end, U.S. Pat. No. 4,645,450 discloses a flow control system for controlling the flow of air and fuel to a burner. Differential pressure sensors are positioned in the air flow and gas flow conduits feeding the burner. Optimal differential pressures of the air and fuel flow are determined through experimentation and flue gas analysis and stored in a microprocessor. These optimal values are compared to measured values during operation, and the flow of air and/or fuel to the burner is regulated based upon that comparison by opening or closing respective valving. This system does not sense the back pressure on the burner. It also generates a fuel flow "signal" indicative of the rate of fuel into the burner rather than through the burner.

Mechanical valves used in conventional systems are connected by adjustable cams and linkages to control the volumetric flow rates of the air and fuel. However, if the air density changes due to atmospheric pressure and/or temperature variations, the air fuel ratio is upset. In addition, mechanical valves are subject to wear and binding of the cams and linkages over time, and considerable skill is required to adjust the device. Systems which use mass flow measuring devices are cost prohibitive.

It is therefore an object of the present invention to optimize the mix of fuel and air in a burner.

It is a further object of the present invention to provide a control system for a burner and thereby increase the efficiency of the burner.

It is another object of the present invention to reduce the flue gas emissions of a burner.

SUMMARY OF THE INVENTION

The problems of the prior art have been overcome by the present invention, which provides a control system and method for regulating the air/fuel mix of a burner for a web dryer or a regenerative or recuperative oxidizer, for example. Differential air pressure is monitored between the air chamber of the burner and the enclosure into which the burner fires (such as a flotation dryer or the combustion chamber of a regenerative thermal oxidizer). Fuel flow is monitored by a differential pressure measurement between the fuel chamber of the burner and the enclosure into which the burner fires. These measurements are compared to predetermined values, and the fuel flow and/or air flow to the burner is regulated accordingly. Regulation of the air flow is achieved with a combustion blower with a variable speed drive controlled motor which has both acceleration and deceleration control, rather than with a damper to achieve faster and more accurate burner modulation and to use less electrical energy. In addition, the preferred drive should incorporate dynamic braking technology for tighter control. Dynamic braking is desired for rapid dissipation of high DC bus voltages that are generated when the motor is rapidly slowed down. The excess voltage is applied to the braking resistors, allowing the motor to slow down faster. The present invention uses the burner housing itself to provide a direct measurement of the air and fuel flow rates, thereby eliminating expensive flow measuring devices.

DETAILED DESCRIPTION OF THE INVENTION

Figure 1:
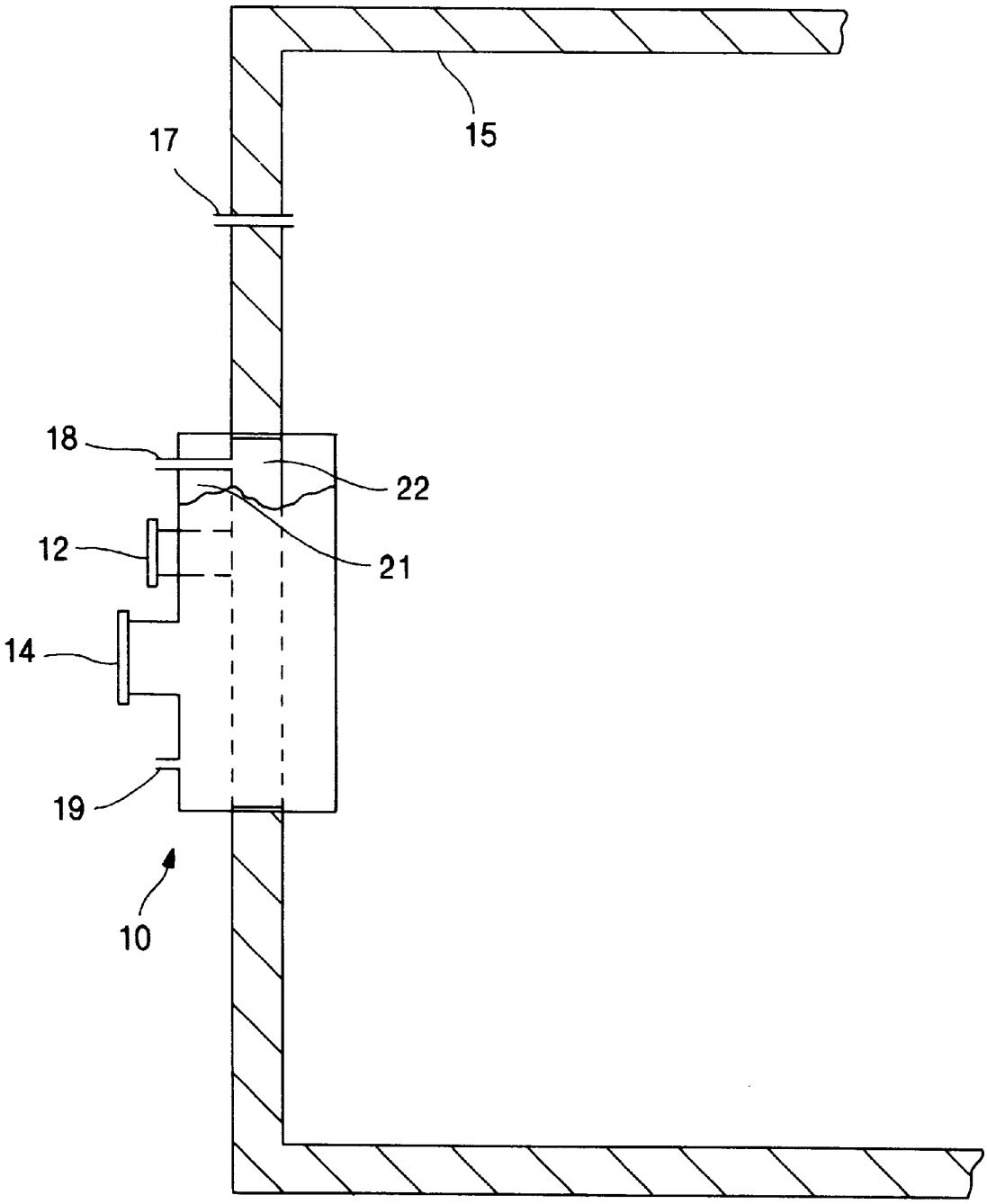
FIG. 1 is a cross-sectional view of the burner of the present invention shown mounted in an enclosure.

Turning first to FIG. 1, there is shown generally at 10 a burner having a fuel inlet 12 and an air inlet 14. These inlets are connected to sources of fuel and air, respectively, by suitable respective conduits, for example. Any suitable combustible fuel can be used as the burner fuel source, such as natural gas, propane and fuel oil. The preferred fuel is natural gas. The burner is shown mounted in enclosure or chamber 15. In one application of the present invention, the enclosure 15 is the housing of an air flotation web dryer. In another application of the present invention, the enclosure 15 is the combustion chamber of a regenerative thermal oxidizer. The foregoing examples of enclosure 15 are exemplary only; those skilled in the art will appreciate that the present invention has applications beyond those illustrated. A pressure port 17 is shown in the enclosure, providing a location for differentially loading the fuel and air pressure sensors as described below. This port should be located near the burner to provide a quick response to enclosure pressure changes. Typically, this port 17 should be within 12 inches of the burner installation. The burner 10 includes a fuel pressure port 18 and an air pressure port 19 as shown. As is conventional in the art, the burner 10 includes an air chamber 21 and a fuel chamber 22.

Figure 3:
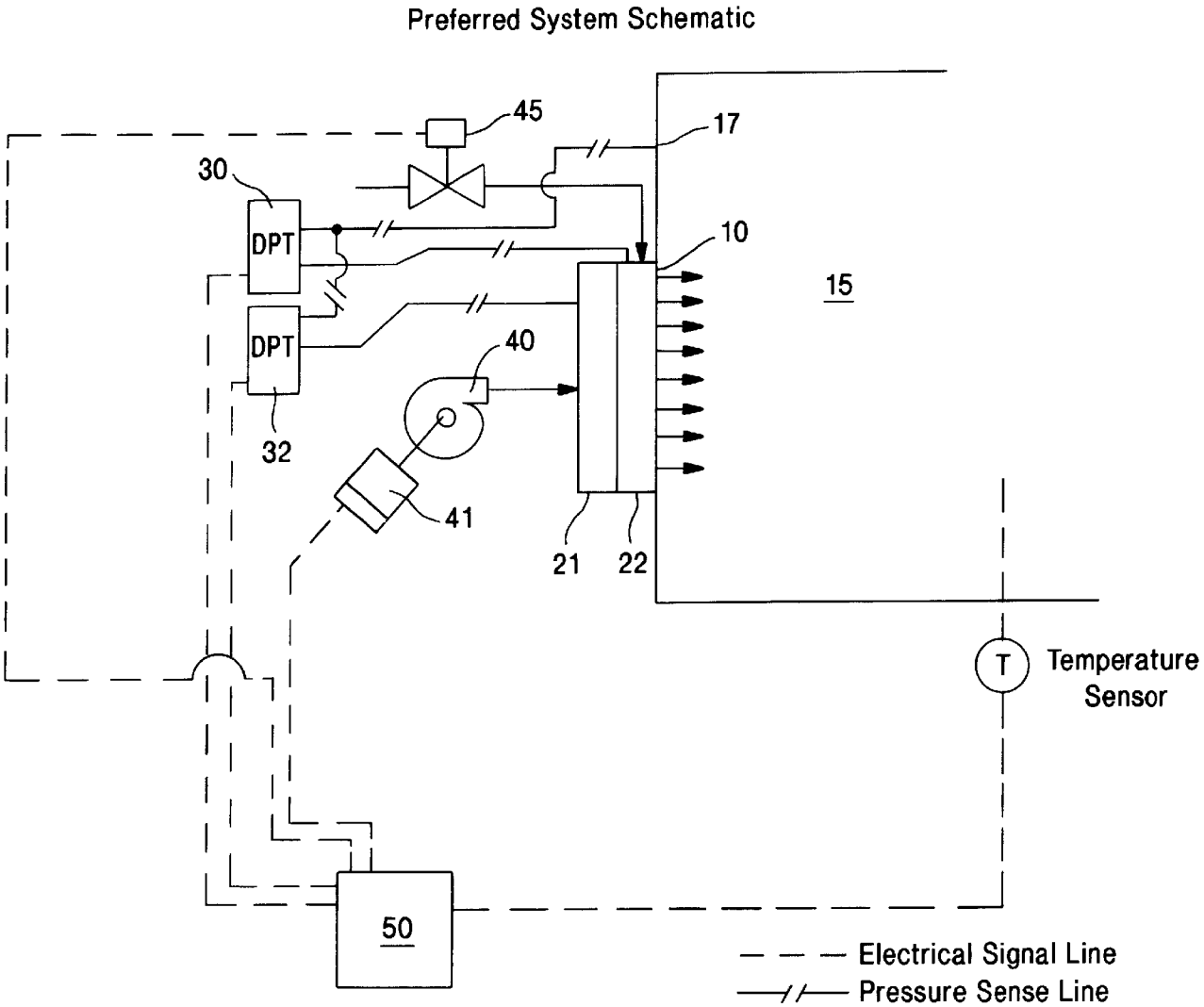
FIG. 3 is a schematic view of the control system in accordance with the present invention.

Turning now to FIG. 3, fuel flow and air flow indicating means will now be described. Fuel differential pressure sensor 30 is shown in communication with burner 10, and more specifically, in communication with the fuel chamber 22 of burner 10. In addition, the fuel differential pressure sensor is in communication with the enclosure through pressure port 17. The fuel differential pressure sensor 30 is also in communication with controller 50, which generally includes a microprocessor having a memory and is preferably a programmable logic controller (PLC). The fuel differential pressure sensor 30 senses the pressure differential between the fuel chamber 22 of the burner 10 and the enclosure 15, and sends a signal indicative of that difference to the controller 50.

Air differential pressure sensor 32 is shown in communication with burner 10, and more specifically, in communication with the air chamber 21 of burner 10. In addition, the air differential pressure sensor 32 is in communication with the enclosure through pressure port 17. The air differential pressure sensor 32 is also in communication with controller 50. The air differential pressure sensor 32 senses the pressure differential between the air chamber 21 of the burner 10 and the enclosure 15, and sends a signal indicative of that difference to the controller 50. Temperature sensor T is also provided in the enclosure and is in communication with the microprocessor 50 to adjust the burner output.

The knowledge of the differential air and fuel pressures allows the air/fuel ratio of the burner to be accurately regulated over the desired burner firing range. It is important to sense the pressure in the enclosure or chamber 15 into which the burner 10 fires, thereby taking into consideration changes in the chamber 15 pressures when regulating the flows to the burner. The enclosure pressure affects burner flame stability, burner output, and air/fuel ratio. Although any suitable pressure sensor could be used, preferably differential pressure transducers are used.

In the preferred embodiment of the present invention, a control valve 45 regulates the flow of fuel to the fuel chamber 22 of the burner 10. The valve 45 is in electrical communication with the controller 50. The flow of air to the burner is regulated using a combustion blower, most preferably a variable speed drive driven fan 40. The fan 40 is in fluid communication, through suitable ductwork (not shown) with the air chamber 21 of the burner 10. The drive 41 for the fan 40 is in electrical communication with the controller 50 as shown. The use of a variable speed drive fan with acceleration and deceleration control provides superior matching of the air/fuel ratio and electrical savings during burner firing rate changes compared to a system where the air flow is modulated with a damper and actuator. Faster burner modulation without sacrifice of accurate air/fuel ratio control is achievable. In addition, the use of a variable speed motor to control flame output eliminates the flow disturbance produced by the damper, thereby greatly reducing the noise produced by the air flow at high firing rates. During periods of low firing rates typical of most burner operation, the motor drive arrangement of the present invention is more energy efficient and quieter than a constant speed motor with a damper.

Figure 2A:
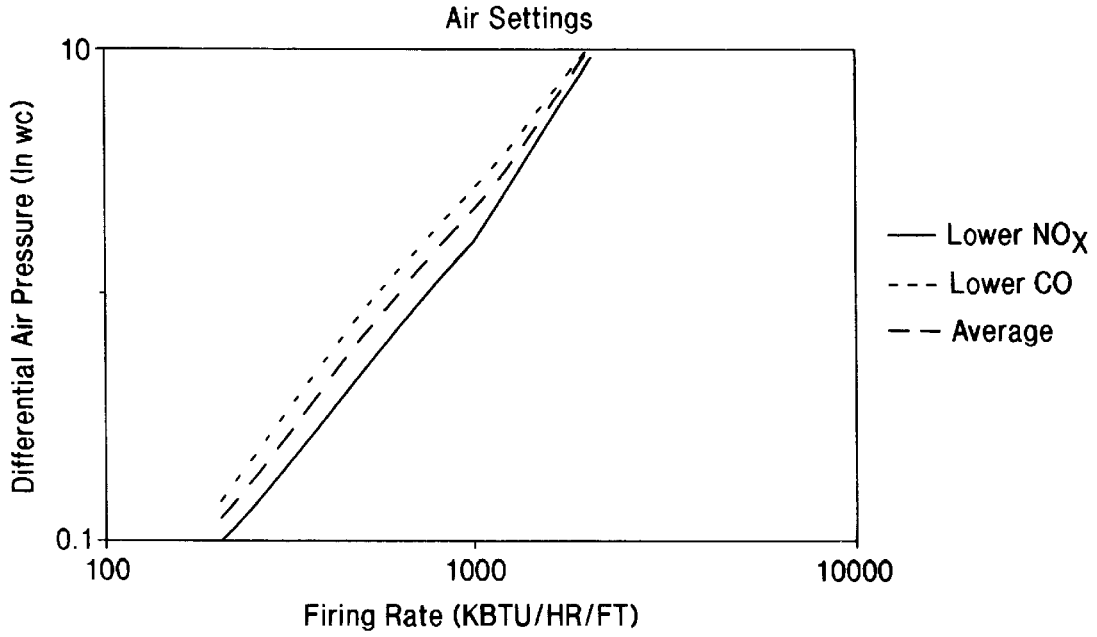
FIG. 2 is a graph of vendor supplied air and fuel settings for a burner.
Figure 2B:
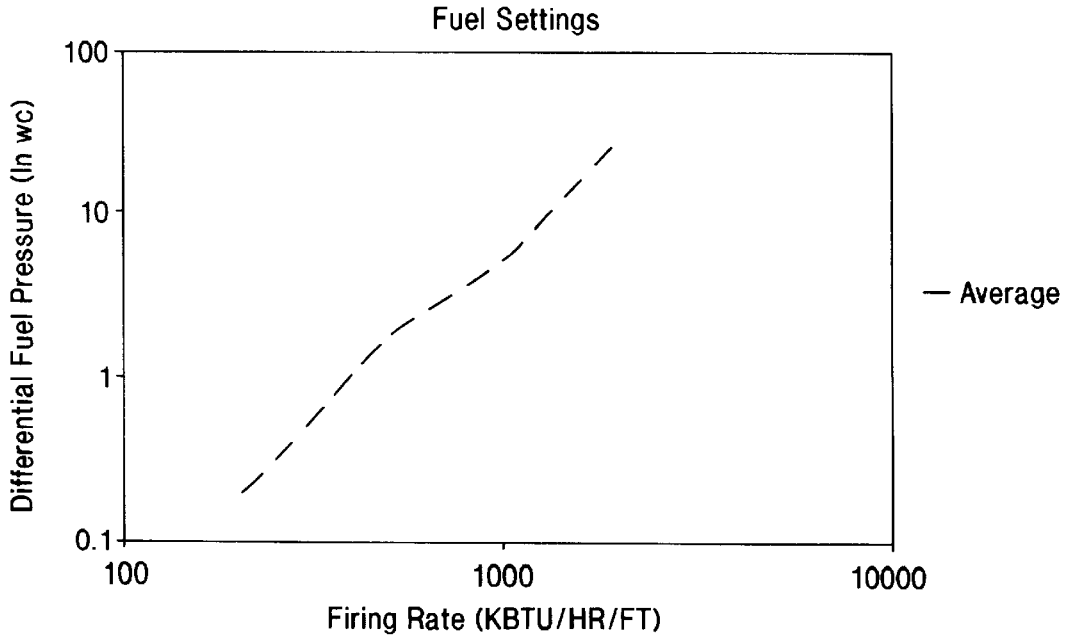

In operation, the system monitors the differential air pressure between the burner air chamber 21 and the enclosure 15. The flow of fuel is also monitored by a differential pressure measurement between the burner fuel chamber 22 and the enclosure 15. Signals indicative of these differential pressure measurements are sent to controller 50, where they are compared to experimental values or vendor supplied curves (FIG. 2) which are based on optimal burner firing rate.

If the density of the air entering the combustion fan changes due to atmospheric pressure or temperature variations, the air differential pressure sensor detects the corresponding density related pressure variation and adjust the fan output to compensate for the change.

Appropriate adjustment of the air/fuel ratio to the burner results in efficient burner operation with the lowest emissions. This also results in the burner flame length being kept short, which can be particularly advantageous in a draw-through heated drying system which may require that the burner be in close proximity to the fan inlet. A long flame length can damage the inlet cone and fan wheel due to high temperature gradients if the flame impinges on the fan components.

Another advantage of this system over the conventional mechanically controlled system is the ability to change the air/fuel ratio at any time or point of operation in a process.

This may allow an oxidizer to run one ratio during start-up and another ratio during the actual operating cycle. Mechanical air/fuel regulating systems could not easily or cost effectively accomodate changes during operation. Also, a change in fuel type could be carried out with no physical set-up changes required for the burner.

EXAMPLE 1

Figure 4:
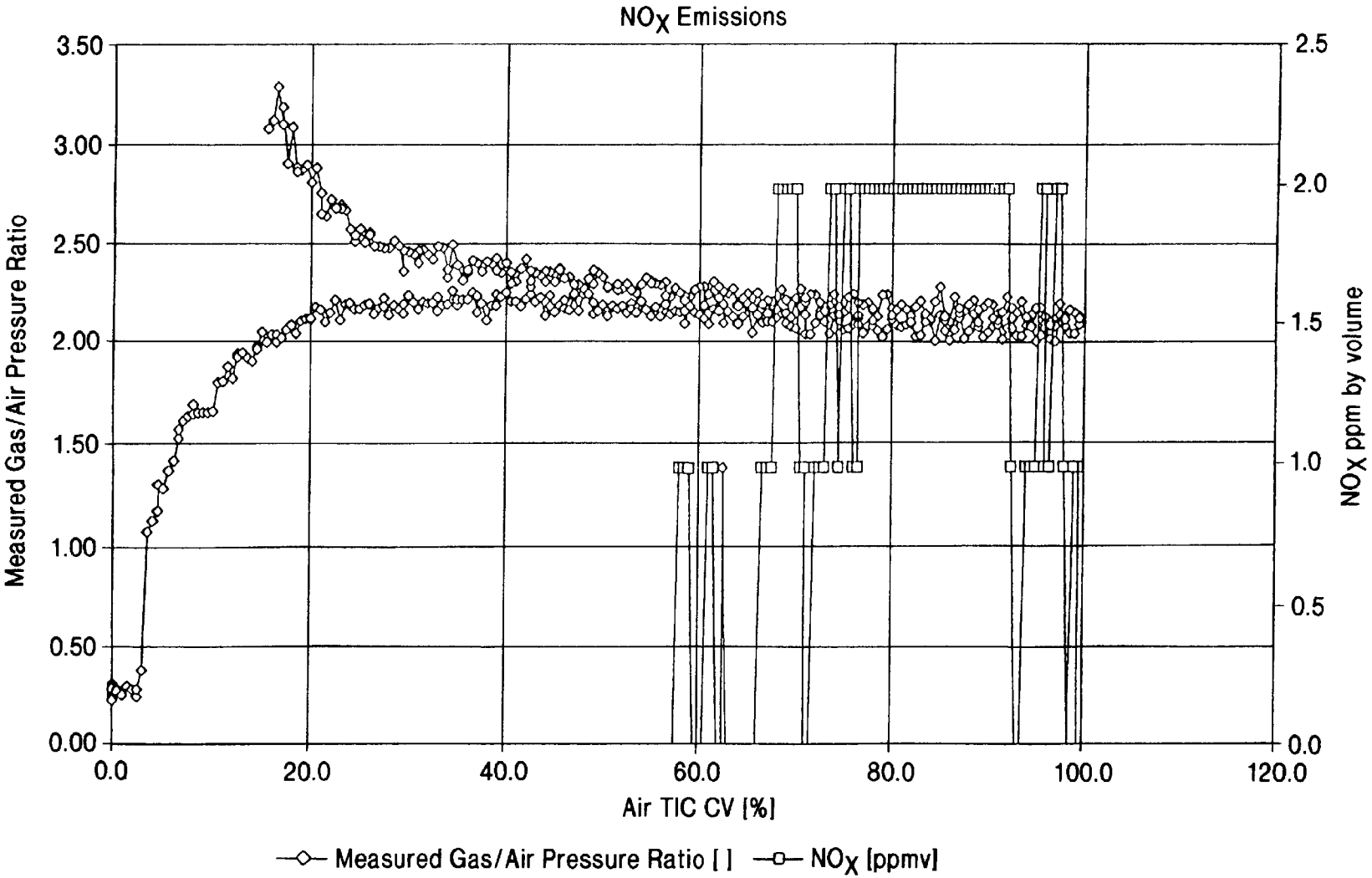
FIG. 4 is a graph showing $NO_x$ emissions of a burner at various fuel/air ratios.
Figure 5:
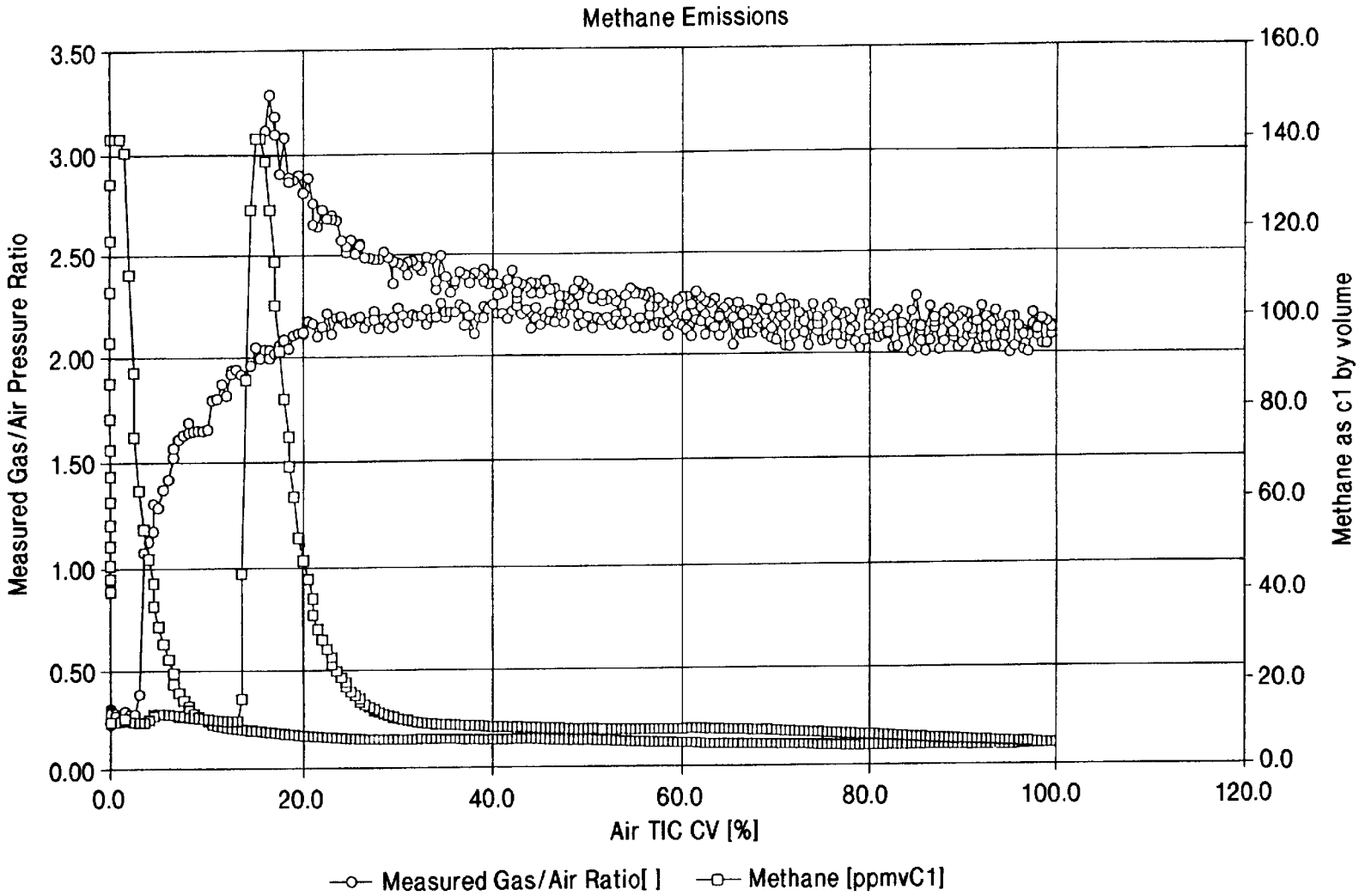
FIG. 5 is a graph showing methane emissions of a burner at various fuel/air ratios.
Figure 6:
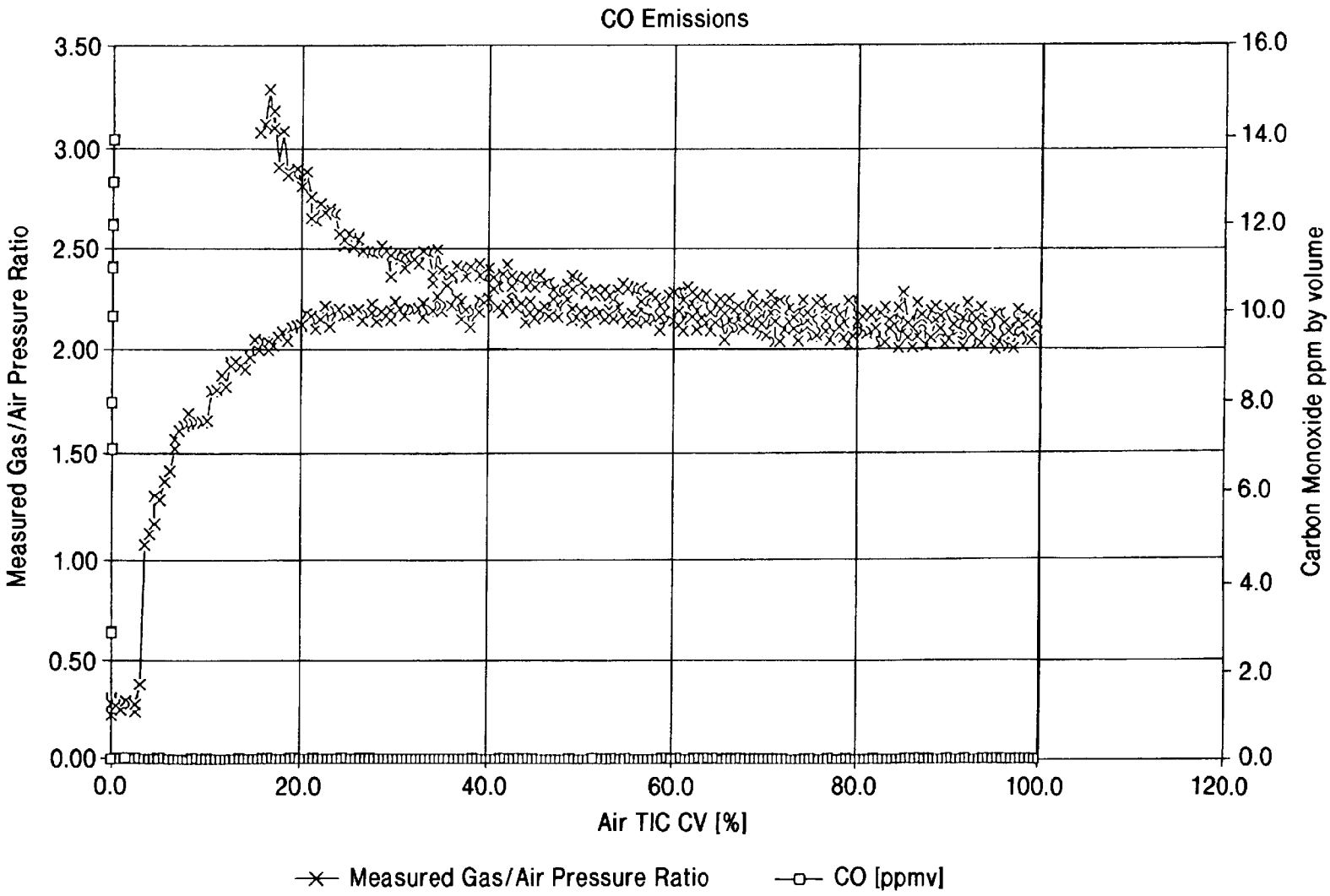
FIG. 6 is a graph showing carbon monoxide emissions of a burner at various fuel/air ratios.

In order to determine the optimum performance of a burner in terms of $NO_x$, CO and $CH_4$ emissions, a burner was started in the pilot mode and then the output to the burner was linearly ramped from 0–100% and back down to the pilot position by the controlling PLC. All signals were run into the PLC. The corresponding data were extracted from the PLC via a direct data exchange (DDE) link into a personal computer running Microsoft EXCEL on a 1 second time sample interval. A portable Enerac combustion analyzer generated the $NO_x$ and CO signals. A portable FID analyzer was used to generate the $CH_4$ ppm signal. The burner air temperature controller output (Air TIC CV (%)), burner gas differential pressure setpoint (SP), burner gas differential pressure process variable (PV), burner gas differential pressure controller output (%), burner air differential pressure setpoint (SP), burner air differential pressure process variable (PV), burner gas differential pressure controller output (%) were recorded with the CO and $NO_x$ measurements using the same time sampling base and the corresponding graphs were plotted as shown in FIGS. 4, 5 and 6. Gas/air pressure ratio values were calculated in the EXCEL spreadsheet.

FIG. 4 shows low $NO_x$ if the fuel/air pressure ratio is held near 2.2. FIG. 5 shows data using a burner having the instant control apparatus. It is seen that if the fuel/air pressure ratio is held near 2.2, the unburned methane will be less than 10 ppm. FIG. 6 shows that CO is essentially zero ppm over the full valve opening range. Again, the fuel/air pressure ratio is near 2.2 except at small valve openings, typically less than 10%.

Figure 7:
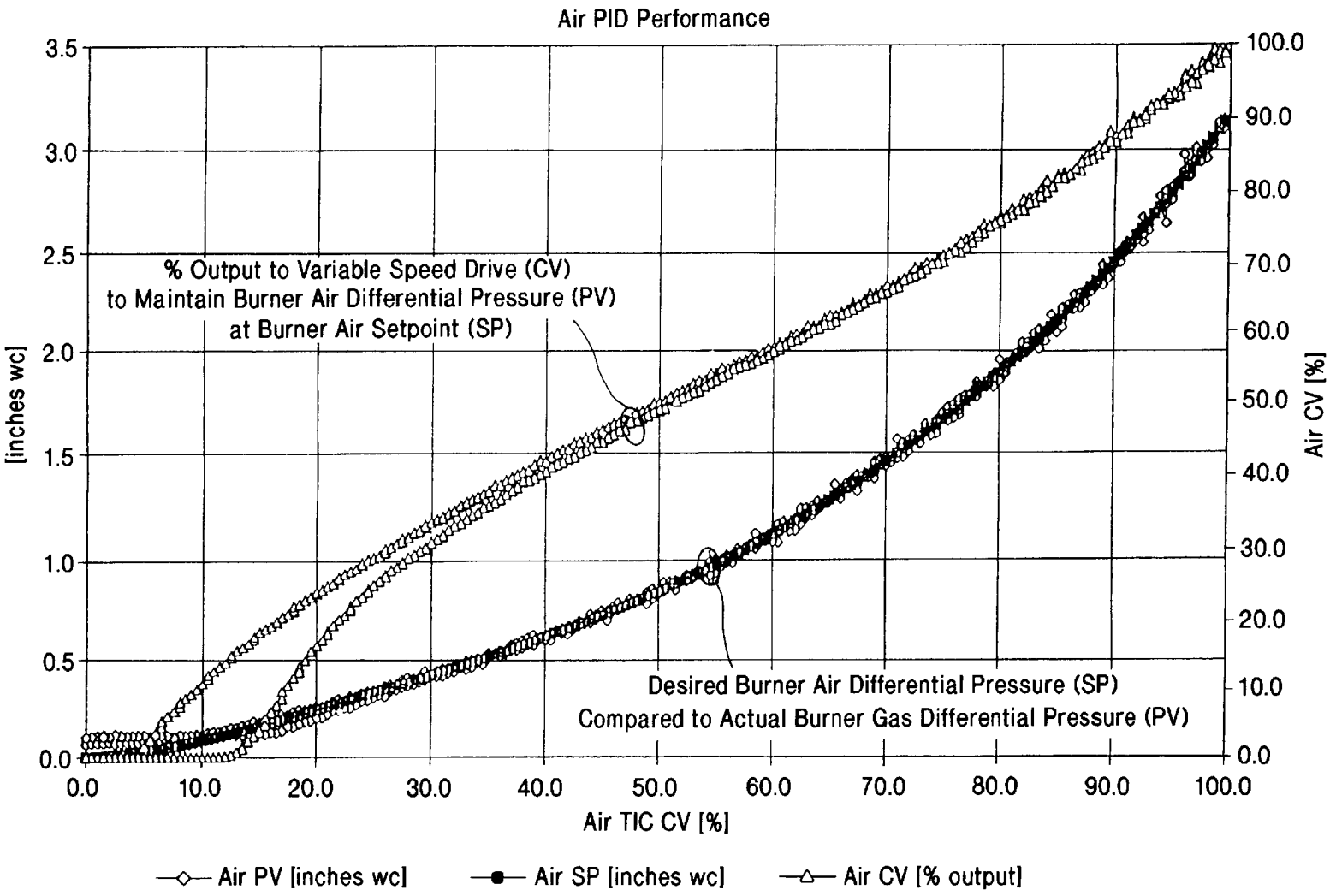
FIG. 7 is a graph comparing the actual air pressure to the desired setpoint over the full valve opening range.
Figure 8:
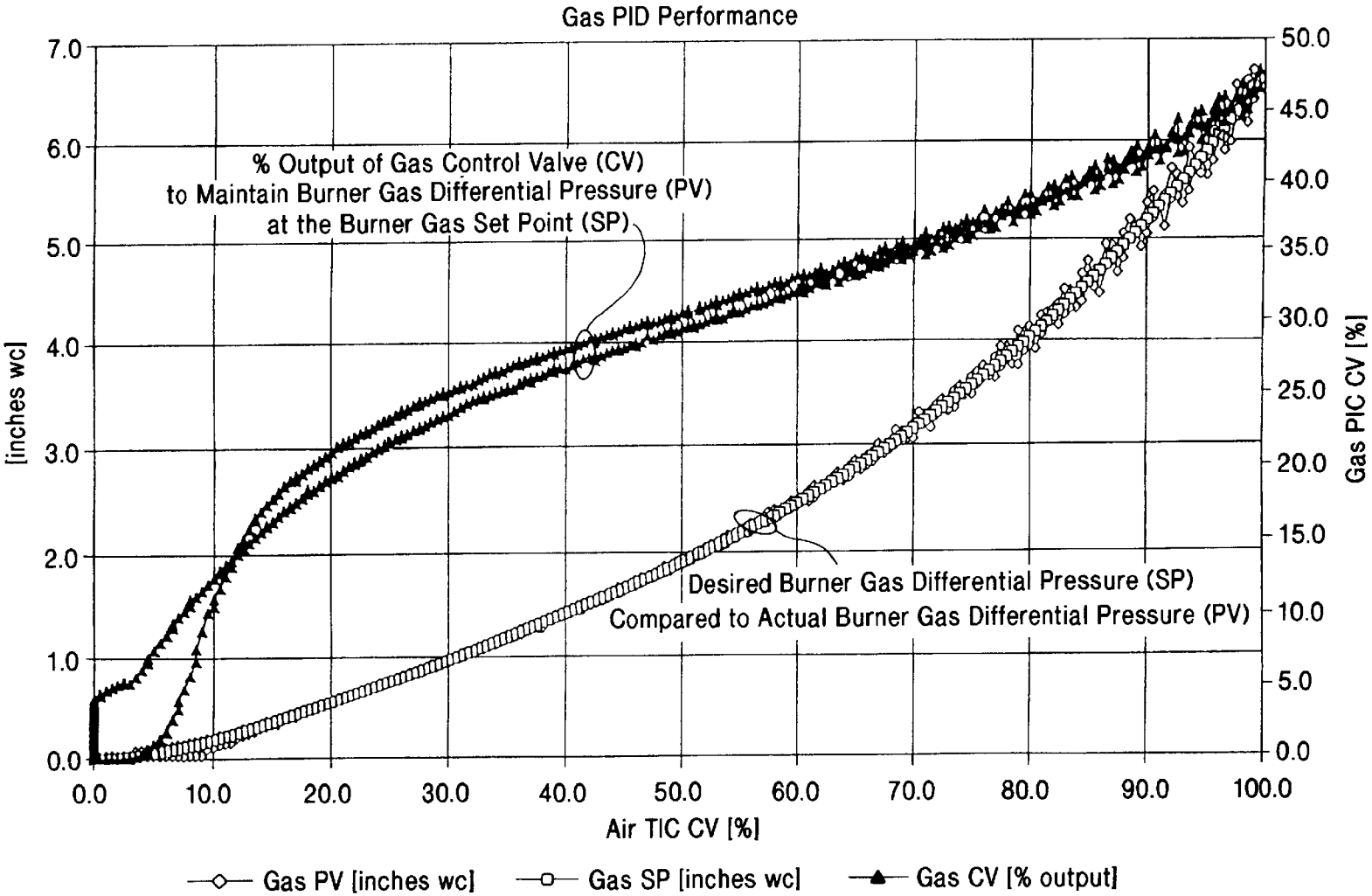
FIG. 8 is a graph comparing the actual fuel pressure to the desired setpoint over the full valve opening range.

FIG. 7 shows the tracking of the actual air pressure versus the desired setpoint over the full valve range. FIG. 8 shows the tracking of the actual gas pressure over the desired setpoint for the full valve range. These data demonstrate that the control apparatus tracks very well.

What is claimed is:

1. A control system for controlling the air to fuel ratio in a burner firing into a firing chamber, said burner having a combustible fuel chamber and an air chamber, said control system comprising:

fuel differential pressure sensing means for measuring the pressure differential between said combustible fuel chamber and said firing chamber and generating a first signal indicative of said measurement;

air differential pressure sensing means for measuring the pressure differential between said air chamber and said firing chamber and generating a second signal indicative of said measurement;

fuel flow control means for controlling the flow of fuel to said fuel chamber of said burner;

air flow control means for controlling the flow of air to said air chamber of said burner; and control means responsively coupled to said fuel differential pressure sensing means, to said air differential pressure sensing means and to said fuel and air flow control means, said control means comparing said first and second signals to predetermined respective non-linear values, and maintaining the ratio of said combustible fuel and said air being fed to said burner based upon said comparison.

2. The control system of claim 1, wherein said air flow control means comprises a variable speed drive driven fan.

3. The control system of claim 3, wherein said variable speed drive comprises dynamic braking.

4. The control system of claim 3, wherein said fan comprises acceleration and deceleration control.

5. A process for controlling the air to fuel ratio in a burner firing into a firing chamber, said burner having a combustible fuel chamber and an air chamber, said process comprising:

measuring the pressure differential between said combustible fuel chamber and said firing chamber and generating a first signal indicative of said measurement;

measuring the pressure differential between said air chamber and said firing chamber and generating a second signal indicative of said measurement;

providing fuel flow control means for controlling the flow of fuel to said fuel chamber of said burner;

providing air flow control means for controlling the flow of air to said air chamber of said burner; and comparing said first and second signals to non-linear predetermined values, and regulating the flow of air and fuel to said burner via said fuel and air flow control means in response to said comparison.

6. The process of claim 5, wherein said air flow control means comprises a variable speed drive driven fan.

7. The process of claim 6, wherein said variable speed drive comprises dynamic braking.

8. The process of claim 7, wherein said variable speed drive comprises acceleration and deceleration control.

* * * * *